US007438601B2

(12) United States Patent
Kobayashi

(10) Patent No.: US 7,438,601 B2
(45) Date of Patent: Oct. 21, 2008

(54) CONNECTOR

(75) Inventor: Katsuhiko Kobayashi, Yamanashi (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 11/425,197

(22) Filed: Jun. 20, 2006

(65) Prior Publication Data

US 2007/0004284 A1 Jan. 4, 2007

(30) Foreign Application Priority Data

Jun. 29, 2005 (JP) ..... 2005-190417

(51) Int. Cl.
*H01R 24/00* (2006.01)

(52) U.S. Cl. ..... 439/636; 439/329; 439/733.1

(58) Field of Classification Search ..... 439/62, 439/64, 79, 80, 326, 327, 329, 637, 733.1, 439/83, 636
See application file for complete search history.

(56) References Cited

U.S. PATENT DOCUMENTS 4,275,944 A * 6/1981 Sochor ..... 439/267
5,082,459 A * 1/1992 Billman et al. ..... 439/637
5,259,793 A * 11/1993 Yamada et al. ..... 439/637
5,393,234 A * 2/1995 Yamada et al. ..... 439/62
5,839,913 A * 11/1998 Fumikura ..... 439/326
5,915,979 A * 6/1999 Schell et al. ..... 439/83
6,210,194 B1 * 4/2001 Choy ..... 439/326
6,305,952 B1 * 10/2001 Yu ..... 439/83
7,048,567 B2 * 5/2006 Regnier et al. ..... 439/329
7,114,965 B2 * 10/2006 Jin ..... 439/83
2007/0004284 A1 * 1/2007 Kobayashi ..... 439/636

FOREIGN PATENT DOCUMENTS

JP 05-159831 6/1993
JP 06-031088 4/1994

* cited by examiner

*Primary Examiner*—James Harvey
(74) *Attorney, Agent, or Firm*—Barley Snyder LLC

(57) ABSTRACT

A connector includes a plurality of first contacts each having a contact arm that contacts a first surface of an object of connection and a plurality of second contacts each having a contact arm that contacts a second surface of the object of connection. The plurality of first and second contacts are alternately disposed in a contact arrangement direction in a housing. Each of the first contacts has a first projection that extends from a front end of the base member adjacent to a lower press-fitting member along an axial direction of a first contact accommodating compartment. Each of the second contacts has a second projection that extends from a front end of a base member adjacent to an upper press-fitting member along an axial direction of a second contact accommodating compartment. The first and second projections contact inner wall surfaces of projection receiving openings formed in the housing.

9 Claims, 10 Drawing Sheets

CONNECTOR

FIELD OF THE INVENTION

The invention relates to a connector having a plurality of first and second contacts alternately disposed in a contact arrangement direction wherein the first contacts have contact arms that contact a first or upper surface of an object of connection, such as a mating contact, and the second contacts have contact arms that contact a second or lower surface on a side opposite from the first surface of the object of connection.

BACKGROUND OF THE INVENTION

FIG. 10 shows an example of a card edge connector 101 that is connected to a card C or other object of connection according to the prior art (see JP6-31088U). As shown in FIG. 10, the card edge connector 101 comprises an insulating housing 110 having a card receiving groove 111 that extends in a direction of length. A plurality of first contacts 120 and second contacts 120' are attached to the housing 110. Each of the first contacts 120 comprises a substantially rectangular base member 121, an attachment leg 122 that extends forward (rightward in FIG. 10) from the base member 121, a board connecting member 123 that extends from a lower edge of the base member 121, and a contact arm 125 that extends from an upper edge of the base member 121. Each of the contact arms 125 extends via a bent member 124 that extends forward from the upper edge of the base member 121 in a bent manner. From the bent member 124, each of the contact arms 125 first extends forward obliquely upward and then extends further forward while gradually inclining downward. A contact projection 126 that contacts a conductor pad (not shown) provided on an upper surface of the card C is provided at a front end of each of the contact arms 125. Each of the attachment legs 122 is designed to be press-fitted to a corresponding attachment opening 112 formed in the housing 110. Each of the board connecting members 123 is designed to be connected by soldering to a conductor pad provided on a circuit board PCB. Each of the first contacts 120 is formed by stamping a conductive metal plate.

Each of the second contacts 120' comprises a substantially rectangular base member 121', an attachment leg 122' that extends forward from the base member 121', a board connecting member 123' that extends from a lower edge of the base member 121', and a contact arm 125' that extends from an upper edge of the base member 121'. Each of the contact arms 125' extends via a bent member 124' that extends forward from the upper edge of the base member 121' in a bent manner. From the bent member 124', each of the contact arms 125' first extends forward obliquely downward and then extends further forward while gradually inclining upward. A contact projection 126' that contacts a conductor pad (not shown) provided on a lower surface of the card C is provided at a front end of each of the contact arms 125'. Each of the attachment legs 122' is designed to be press-fitted to the corresponding attachment opening 112 formed in the housing 110. Each of the board connecting members 123' is designed to be connected by soldering to a conductor pad provided on the circuit board PCB. Each of the second contacts 120' is formed by stamping a conductive metal plate.

The first and second contacts 120, 120' are alternately disposed in a contact arrangement direction (direction of length of the receiving groove 111) and are designed so that the contact arms 125 and contact arms 125' do not overlap with each other, as shown in FIG. 10. By alternately disposing the first and second contacts 120, 120' in the contact arrangement direction, the first contacts 120 having the contact arms 125 contact the upper surface of the card C and the second contacts 120' having the contact arms 125' contact the lower surface of the card C. Stress applied to the housing 110 that holds the attachment legs 122, 122' is therefore dispersed, so that damage to the housing 110 and cracking in the soldered portions of the board connecting members 123, 123' can also be prevented.

In the card edge connector 101 shown in FIG. 10, the first and second contacts 120, 120' that are disposed in the contact arrangement direction are devised so that the contact arms 125 and the contact arms 125' do not overlap with each other as seen in FIG. 10. The areas of the first and second contacts 120, 120' other than the first and contact arms 125, 125', however, do overlap with each other. Accordingly, capacitive coupling occurs between adjacent first and second contacts 120, 120', so that impedance becomes small. For example, in cases where the contact pitch between adjacent first and second contacts 120, 120' is as small as 0.6 mm. It is therefore difficult to adjust the impedance to a specified value such as 100 Ω.

FIGS. 11A-11B show an example of a high-density connector 201 according to the prior art (see JP5-159831A). Although the high-density connector 201 is a different type of connector than the card edge connector 101 shown in FIG. 10, the high-density connector 201 reduces the capacitance produced between adjacent terminals by reducing opposing areas of adjacent terminals, thus reducing crosstalk between the adjacent terminals.

As shown in FIG. 11B, the high-density connector 201 comprises an insulating housing 210 provided with terminal accommodating openings 211 formed in a plurality of rows. A plurality of first and second terminals 220, 221 is accommodated inside the terminal accommodating openings 211. Ground plates 223 are provided on an outer circumference of the housing 210 and between the rows of the first and second terminals 220, 221. The ground plates 223 provided on the outer circumference of the housing 210 are not shown in the figures.

As shown in FIG. 11A, each of the first terminals 220 comprises a straight body member **220*a* that extends in a vertical direction and has a sectional U shape, a connecting member 220*b* that is formed by being extended outward from a lower edge of a back wall of the straight body member 220*a* and then bent downward, and a pair of contact members 220*c* that respectively extend in an opposing manner from upper edges of opposing side walls of the straight body member 220*a*. A plurality of corner openings 220*d* are formed at both corner edges (where the opposing side walls and the back wall of each of the straight body members 220*a* contact with each other) at a specified interval along the vertical direction. Each of the first terminals 220** is formed by stamping and forming a metal plate.

Each of the second terminals 221 comprises a straight body member **221*a* that extends in the vertical direction and that has a sectional U shape, a connecting member 221*b* that is formed by being extended inward from a lower edge of a back wall of the straight body member 221*a* and then bent downward, and a pair of contact members 221*c* that respectively extend in an opposing manner from the upper edges of the opposing side walls of the straight body member 221*a*. A plurality of corner openings 221*d* formed at both corner edges of each of the straight body members 221*a* at a specified interval along the vertical direction. Each of the second terminals 221** is formed by stamping and forming a metal plate.

The first terminals 220 and second terminals 221 are alternately disposed in the contact arrangement direction so that the opposing side walls overlap, as shown in FIG. 11B. The opposing areas of the adjacent first and second terminals 220, 221 can be reduced by appropriately setting the size of the corner openings 220*d*, 221*d* that are formed in the first and second terminals 220, 221. Accordingly, the capacitance produced between the adjacent first and second terminals 220, 221 can be reduced. As a result, crosstalk between the adjacent terminals first and second terminals 220, 221 can be reduced.

In the high-density connector 201 shown in FIGS. 11A-11B, although it is possible to reduce the capacitance produced between adjacent first and second terminals 220, 221 by reducing the opposing areas of adjacent first and second terminals 220, 221, the first and second terminals 220, 221 have straight base members 220*a*, 221*a* that each having a sectional U shape. The first and second terminals 220, 221 are therefore large, which makes the making first and second terminals 220, 221 unsuitable for use in a compact, low-profile connector.

BRIEF SUMMARY OF THE INVENTION

The present invention was devised in light of the problems described above. It is therefore an object of the present invention to provide a connector which makes it possible to easily adjust the impedance to a specified level without increasing the size of the connector and to provide a connector in which a plurality of first contacts have a contact arm that contacts a first or upper surface of an object of connection and a plurality of second contacts have a contact arm that contacts a second or lower surface on a side opposite side from the first surface of the object of connection in which the first and second contacts are alternately disposed in a contact arrangement direction.

This and other objects are achieved by a connector comprising an insulating housing having first contact accommodating compartments and projection receiving openings. First contacts arranged in the first contact accommodating compartments. Each of the first contacts has a substantially rectangular base member with an upper surface provided with an upper press-fitting member and a lower surface provided with a lower press-fitting member press-fitted into the first contact accommodating compartments. The base member has a contact arm extending from a front end thereof. A board connecting member extends from a rear end thereof, and a first projection extends from the front end thereof adjacent to the lower press-fitting member along an axial direction of the first contact accommodating compartment. The first projection contacts inner wall surfaces of the projection receiving opening.

This and other objects are further achieved by a connector comprising an insulating housing having first and second contact accommodating compartments alternately disposed in a single row in a contact arrangement direction and projection receiving openings. First contacts arranged in the first contact accommodating compartments and second contacts arranged in the second contact accommodating compartments. Each of the first and second contacts has a substantially rectangular base member with an upper surface provided with an upper press-fitting member and a lower surface provided with a lower press-fitting member press-fitted into the first contact accommodating compartments. The base member has a contact arm extending from a front end thereof and a board connecting member extending from a rear end thereof. A first projection extends from a front end of the base member of the first contacts adjacent to the lower press-fitting member along an axial direction of the first contact accommodating compartment. A second projection extends from a front end of the base member of the first contacts adjacent to the upper press-fitting member along an axial direction of the first contact accommodating compartment. The first and second projections contact inner wall surfaces of the projection receiving opening.

DETAILED DESCRIPTION OF THE INVENTION

Figure 1:
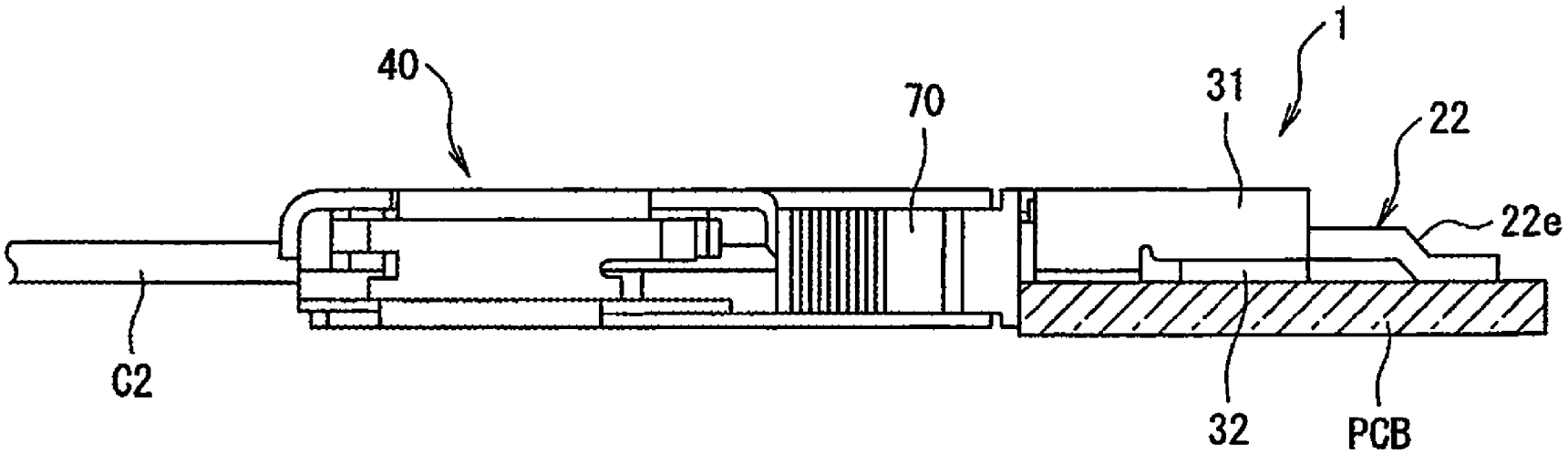
FIG. 1 is a partial cross-sectional side view of a connector according to the present invention shown mated with a mating connector.
Figure 2A:
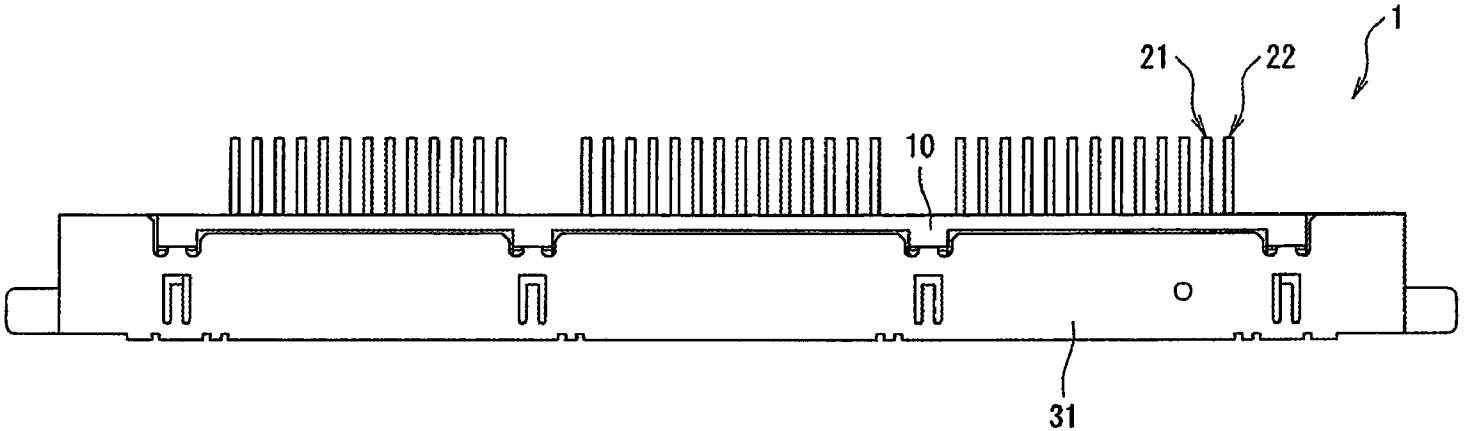
FIG. 2A is a plan view of the connector.
Figure 2B:
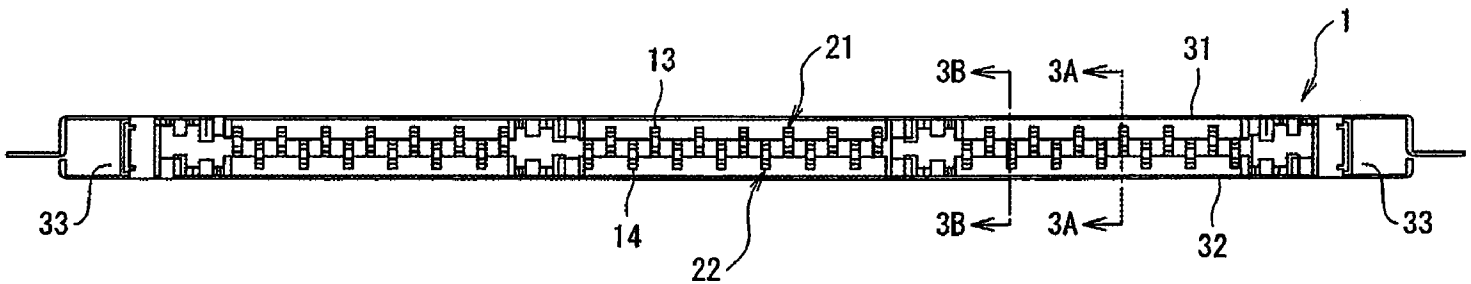
FIG. 2B is a front view of the connector.
Figure 2C:
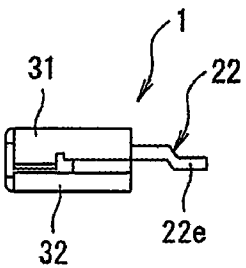
FIG. 2C is a right-side view of the connector.
Figure 3A:
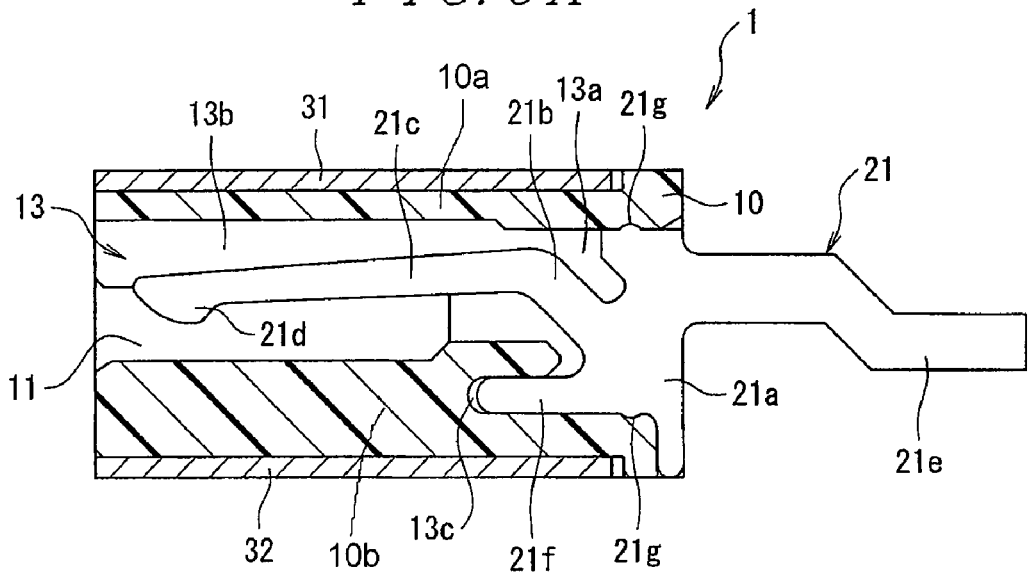
FIG. 3A is a sectional view along line 3A-3A of FIG. 2B.
Figure 3B:
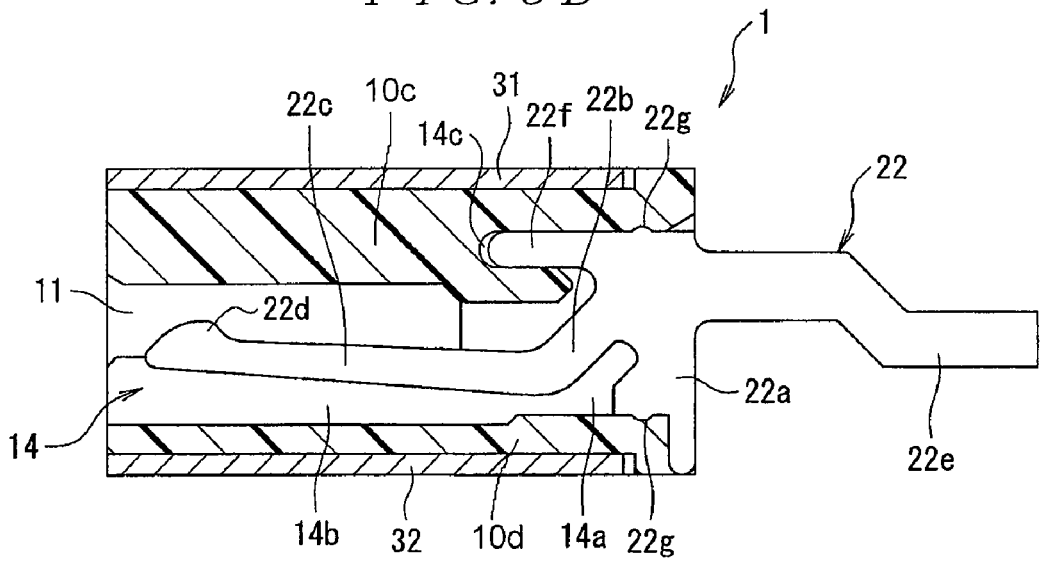
FIG. 3B is a sectional view along line 3B-3B of FIG. 2B.

An embodiment of the present invention will now be described with reference to the figures. FIG. 1 shows a connector 1 mounted on a circuit board PCB and mated with a mating connector 40. As shown in FIG. 2A, the connector 1 comprises an insulating housing 10. The housing 10 has a substantially rectangular shape and extends in a direction of length. As shown in FIGS. 3A-3B, the housing 10 has a mating member receiving recess 11 that extends in the direction of length. As shown in FIG. 2B, a plurality of first contact accommodating compartments 13 and a plurality of second contact accommodating compartments 14 are formed in a single row in the housing 10. The first and second contact accommodating compartments 13, 14 are alternately disposed along the direction of length of the housing 10.

As shown in FIG. 3A, each of the first contact accommodating compartments 13 comprises an upper wall 10*a* and a lower wall 10*b* extending in an axial direction of the first contact accommodating compartment 13. A press-fitting opening 13*a* extends rearward (rightward in FIG. 3A) from the mating member receiving recess 11 and opens on a rear surface of the housing 10. A contact arm opening 13*b* extends forward from the press-fitting opening 13*a* from above the mating member receiving recess 11. The contact arm opening 13*b* opens on front end surfaces of the mating member receiving recess 11 of the housing 10. A projection receiving opening 13*c* is formed in the lower end portion of the press-fitting opening 13*a* and extends forward.

As shown in FIG. 3B, each of the second contact accommodating compartments 14 comprises an upper wall 10*c* and a lower wall 10*d* extending in an axial direction of the second contact accommodating compartment 14. A press-fitting opening 14*a* extends rearward (rightward in FIG. 3B) from the mating member receiving recess 11 and opens on the rear surface of the housing 10. A contact arm opening 14*b* extends forward from the press-fitting opening 14*a* and beneath the mating member receiving recess 11. The contact arm opening 14*b* opens on the front end surfaces of the mating member receiving recess 11 of the housing 10. A projection receiving opening 14*c* is formed in the upper end portion of the press-fitting opening 14*a* and extends forward. The housing 10 may be formed, for example, by molding an insulating resin.

As shown in FIG. 3A, a plurality of first contacts 21 are accommodated inside the first contact accommodating compartments 13. Each of the first contacts 21 may be formed, for example, by stamping a conductive metal plate. Each of the first contacts 21 comprises a base member 21*a*, an inclined member 21*b*, a contact arm 21*c*, a contact projection 21*d*, a board connecting member 21*e*, a first projection 21*f*, and upper and lower press-fitting members 21*g*. The base member 21*a* has a substantially rectangular shape. The inclined member 21*b* extends forward at an inclination from a front end of the base member 21*a* and toward a side of the housing 10 opposite from the first projection 21*f*. The contact arm 21*c* extends forward from the inclined member 21*b*. The contact projection 21*d* is provided at a front end of each of the contact arms 21*c*. Each of the board connecting members 21*e* extends from a rear end of the base member 21*a* and is configured to be connected, for example, by soldering to a conductor pattern on the circuit board PCB. The upper and lower press-fitting members 21*g* are provided on side surfaces of the base member 21*a* in a direction of width (upper and lower surfaces of the base member 21*a*) and are designed to be press-fitted to the press-fitting opening 13*a* of the housing 10. Each of the first projections 21*f* extends from the front end of the base member 21*a* adjacent to the lower press-fitting members 21*g* along the axial direction of the first contact accommodating compartment 13.

The base member 21*a* and the press-fitting members 21*g* of each of the first contacts 21 enter the corresponding press-fitting openings 13*a* and engage the upper and lower walls 10*a*, 10*b* so that the press-fitting members 21*g* are press-fitted therein. The inclined member 21*b* and the contact arm 21*c* of each of the first contacts 21 are accommodated in the corresponding contact arm openings 13*b*. The projection receiving opening 13*c* is designed to be contacted by both side surfaces (upper and lower surfaces) of the first projection 21*f* of each of the first contacts 21 when the first projection 21*f* is received therein.

As shown in FIG. 3B, a plurality of second contacts 22 are accommodated inside the second contact accommodating compartments 14. Each of the second contacts 22 may be formed, for example, by stamping a conductive metal plate. Each of the second contacts 22 comprises a base member 22*a*, an inclined member 22*b*, a contact arm 22*c*, a contact projection 22*d*, a board connecting member 22*e*, a second projection 22*f*, and upper and lower press-fitting members 22*g*. The base member 22*a* has a substantially rectangular shape. The inclined member 22*b* extends forward at an inclination from a front end of the base member 22*a* and toward a side of the housing 10 opposite from the second projection 22*f*. The contact arm 22*c* extends forward from the inclined member 22*b*. The second contacts 22 are designed so that the contact arms 22*c* do not substantially overlap with the contact arms 21*c*, as seen in a side view. The contact projection 22*d* is provided at a front end of each of the contact arms 22*c*. Each of the board connecting members 22*e* extends from the rear end of the base member 22*a* and is configured to be connected, for example, by soldering to the conductor pattern on the circuit board PCB. The upper and lower press-fitting members 22*g* are provided on side surfaces of the base member 22*a* in a direction of width (upper and lower surfaces of the base member 22*a*) and are designed to be press-fitted to the press-fitting opening 14*a* of the housing 10. Each of the second projections 22*f* extends from the front end of the base member 22*a* adjacent to the upper press-fitting member 22*g* along the axial direction of the second contact accommodating compartment 14.

The base member 22*a* and the press-fitting members 22*g* of each of the second contacts 22 enter the corresponding press-fitting openings 14*a* and engage the upper and lower walls 10*c*, 10*d* so that the press-fitting members 22*g* are press-fitted therein. The inclined member 22*b* and the contact arm 22*c* of each of the second contacts 22 are accommodated in the corresponding contact arm openings 14*b*. The projection receiving opening 14*c* is designed to be contacted by both side surfaces (upper and lower surfaces) of the second projection 22*f* of each of the second contacts 22 when the second projection 22*f* is received therein.

As a result of the first contacts 21 being accommodated inside the first contact accommodating compartments 13 and the second contacts 22 being accommodated inside the second contact accommodating compartments 14, the plurality of first contacts 21 and the second contacts 22 are alternately disposed in a contact arrangement direction (in the direction of length of the housing 10). As a result, the first contacts 21 and the second contacts 22 respectively contact mating contacts 60 (to be described later) of the mating connector 40 alternately from above and below in the contact arrangement direction.

As shown in FIGS. 1 and 2A-2C an upper shell 31 covers an upper surface and both side surfaces of the housing 10 in the direction of length. The upper shell 31 may be formed, for example, by stamping and forming a metal plate. A lower shell 32 covers a lower surface and both side surfaces of the housing 10 in the direction of length. The lower shell 32 is connected to the upper shell 31 so that the upper shell 31 is grounded to the circuit board PCB. The lower shell 32 may be formed, for example, by stamping and forming a metal plate.

In the connector 1 according to the invention, each of the first contacts 21 has the first projection 21*f* that extends from the front end of the base member 21*a* adjacent to the lower press-fitting member 21*g* along the axial direction of the first contact accommodating compartment 13, and each of the second contacts 22 has the second projection 22*f* that extends from the front end of the base member 22*a* adjacent to the upper press-fitting member 22*g* along the axial direction of the second contact accommodating compartment 14. The housing 10 has projection receiving openings 13*c*, 14*c* that respectively receive the first and second projections 21*f*, 22*f* and contact both side surfaces of the respective first and second projections 21*f*, 22*f* in a non-press-fitted state. Accordingly, the first and second projections 21*f*, 22*f* are respectively supported by the inner wall surfaces of the projection receiving openings 13*c* 14*c*, so that the positions of the tip ends of the first and contact arms 21*c*, 22*c* and the solder connections of the board connecting members 21*e*, 22*e* are stabilized even if the dimensions of the upper and lower press-fitting members 21*g*, 22*g* in the housing 10 along the axial direction of the first and second contact accommodating compartments 13, 14 and the accompanying dimensions of the base members 21*a*, 22*a* are reduced. It is therefore possible to reduce the dimensions of the upper and lower press-fitting members 21*g*, 22*g* in the housing 10 and the dimensions of the base members 21*a*, 22*a*.

Further, the first and second contacts 21, 22 are arranged in the housing 10 such that there is substantially no overlap, as seen in a side view, between the contact arms 21*c* of the first contacts 21 and the contact arms 22*c* of the second contacts 22. As a result, the capacitance produced between adjacent first and second contacts 21, 22 is reduced. It is therefore possible to easily adjust the impedance to a specified level. In addition, each of the first and contact arms 21*c*, 22*c* extends forward from the respective inclined member 21*b*, 22*b* which extends forward at an inclination from the front end of the base member 21*a* toward a side of the housing 10 opposite from the respective first or second projection 21*f*, 22*f*. Accordingly, it is possible to reduce the length of the connector 1 in the forward-rearward direction while reducing the areas in which the first and second contacts 21, 22 overlap, as seen in the side view. Moreover, since each of the first and second contacts 21, 22 may be formed, for example, by stamping a conductive metal plate, the size of the connector 1 can further be reduced.

Figure 5A:
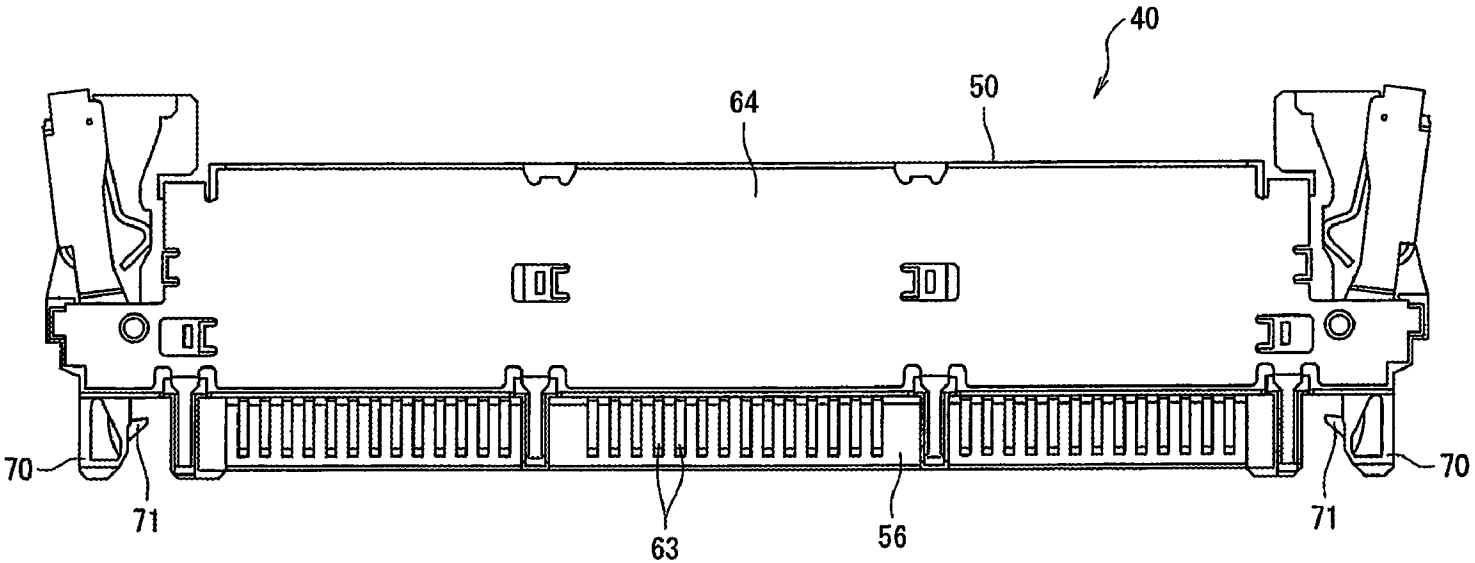
FIG. 5A is a plan view of the mating connector.
Figure 5B:
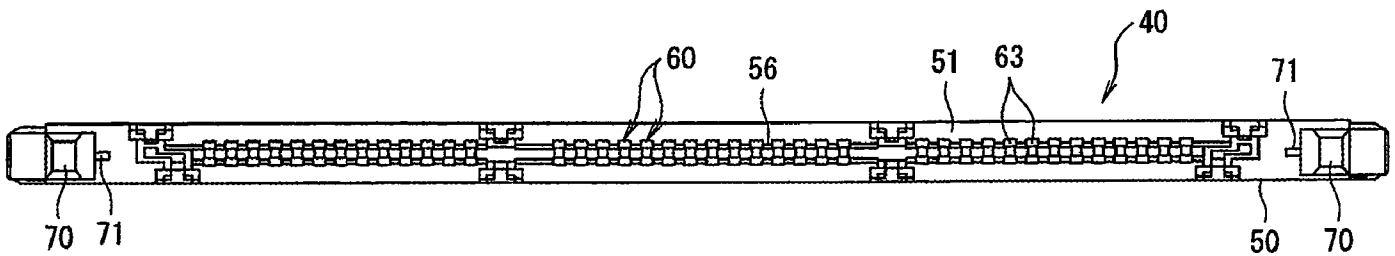
FIG. 5B is a front view of the mating connector.
Figure 5C:
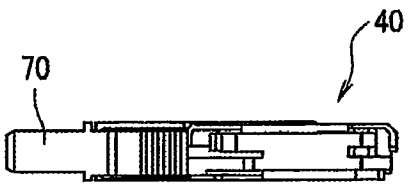
FIG. 5C is a right-side view of the mating connector.
Figure 7A:
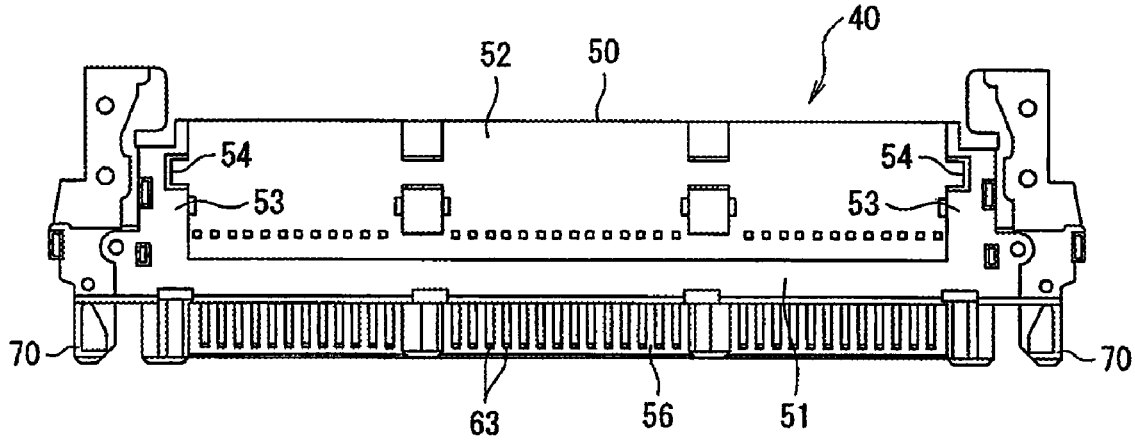
FIG. 7A is a plan view of the ground pin attached to a mating housing of the mating connector prior to the attachment of the ground pin to the mating housing.
Figure 7B:
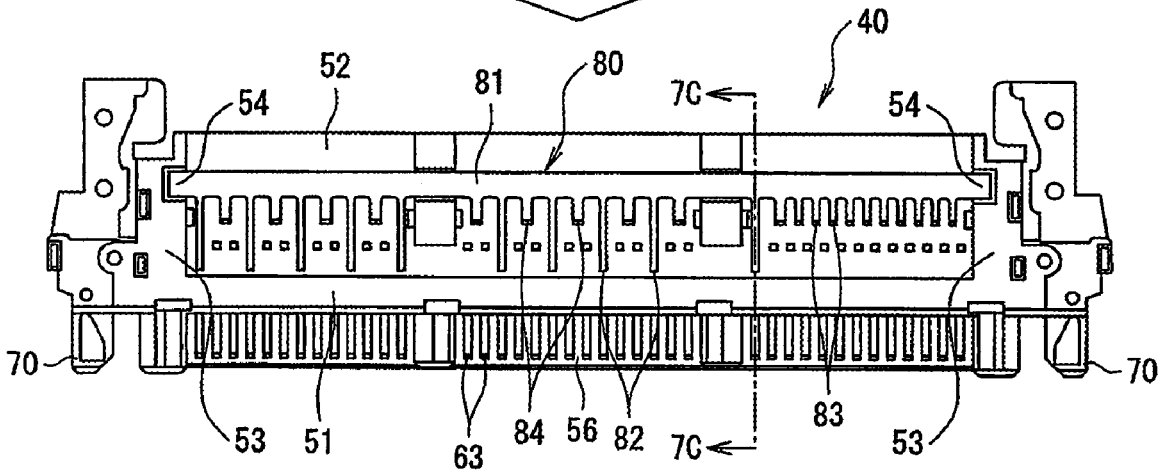
FIG. 7B is a plan view of the ground pin attached to the mating housing of the mating connector following the attachment of the ground pin to the mating housing.
Figure 7C:
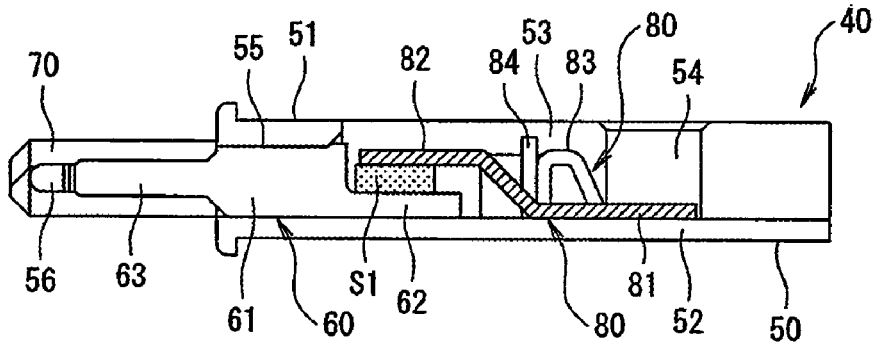
FIG. 7C being a sectional view along line 7C-7C of FIG. 7B.

As shown in FIGS. 5A-5C, the mating connector 40 comprises an insulating mating housing 50. The mating housing 50 may be formed, for example, by molding an insulating resin. As shown in FIGS. 7A-7C, the mating housing 50 comprises a substantially rectangular main body 51 that extends in a direction of length. A thin plate-form extension member 52 extends rearward (rightward in FIG. 7C) from a lower portion of the main body 51. A thin plate-form mating member 56 extends forward substantially from a central portion of the main body 51 in a vertical direction. A plurality of mating contact press-fitting openings 55 configured for the mating contacts 60 to be press-fitted are formed in the main body 51 along the direction of length.

The main body 51 and the extension member 52 are arranged between a pair of side wall members 53 in the direction of length. Ground pin positioning recessed members 54 are provided in inner wall surfaces of the side wall members 53. A pair of guide posts 70 that are used during mating with the connector 1 are provided on side portions of the mating housing 50 in the direction of length. As shown in FIG. 5A, locking members 71 that lock with the connector 1 are provided on inner side surfaces of the guide posts 70. During the mating with the connector 1, the guide posts 70 are inserted into the guide openings 33 (FIG. 2B) in the connector 1, and the locking members 71 lock with locking openings (not shown) formed in inner walls of the guide openings 33. As a result, the connector 1 and the mating connector 40 are locked with each other.

As shown in FIG. 7C, the mating connector 40 is provided with a plurality of mating contacts 60. Each of the mating contacts 60 comprises a substantially rectangular press-fitting member 61 that is press-fitted into the corresponding mating contact press-fitting openings 55 in the mating housing 50. A connecting member 62 extends rearward from the press-fitting member 61. A contact member 63 extends forward from the press-fitting member 61. Each of the contact members 63 extends forward from the press-fitting member 61 so that the upper and lower surfaces of the contact member 63 are exposed in the mating member 56. The mating contacts 60 are aligned along a contact arrangement direction (in the direction of length of the mating housing 50) as a result of the press-fitting members 61 of the mating contacts 60 being press-fitted into the respective mating contact press-fitting openings 55. The plurality of mating contacts 60 are disposed such that the mating contacts 60 that contact the first contacts 21 of the connector 1 and mating contacts 60 that contact the second contacts 22 of the connector 1 are alternately disposed in the contact arrangement direction. The system is devised so that the contact projections 21*d* provided on the contact arms 21*c* of the first contacts 21 contact first or upper surfaces of the contact members 63 of a plurality of the mating contacts 60, and the contact projections 22*d* provided on the contact arms 22*c* of the second contacts 22 contact second or lower surfaces of the contact members 63 of a plurality of the mating contacts 60 when the connector 1 and the mating connector 40 are mated. Each of the mating contacts 60 may be formed, for example, by stamping a conductive metal plate.

Figure 9A:
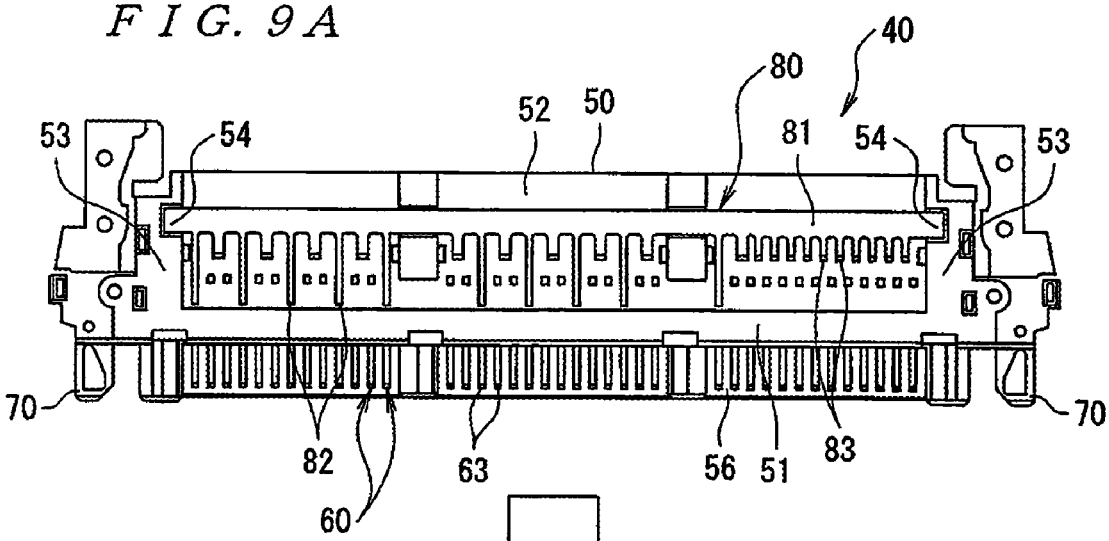
FIG. 9A is a plan view of the ground bar attached to the mating housing of the mating connector prior to the attachment of the ground pin to the mating housing.
Figure 9B:
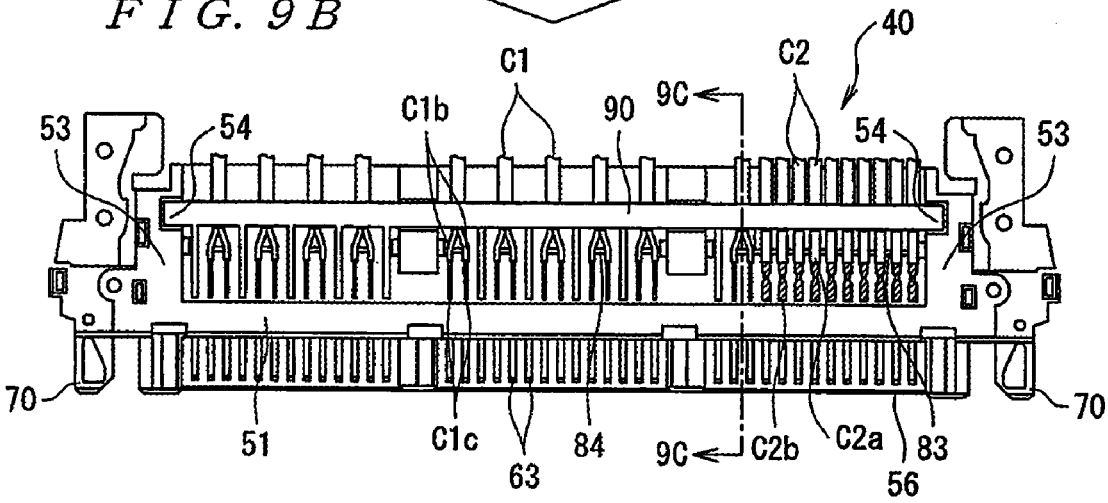
FIG. 9B is a plan view of the ground bar attached to the mating housing of the mating connector following the attachment of the ground pin to the mating housing.
Figure 9C:
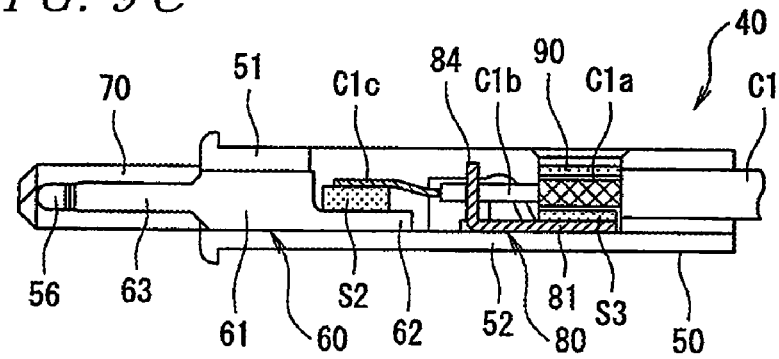
FIG. 9C is a sectional view along line 9C-9C of FIG. 9B.
Figure 10:
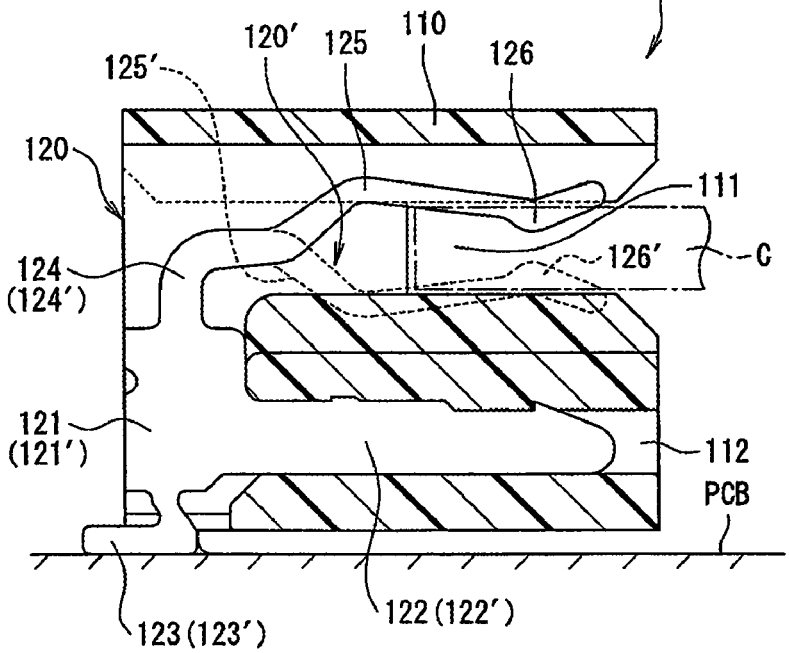
PRIOR ART FIG. 10
FIG. 10 is a sectional view of a card edge connector according to the prior art.
Figure 11A:
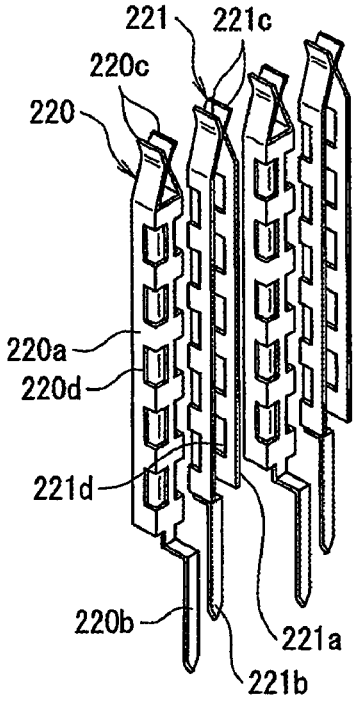
PRIOR ART FIG. 11A
FIG. 11A is a perspective view of a terminal arrangement of a high-density connector according to the prior art.
Figure 11B:
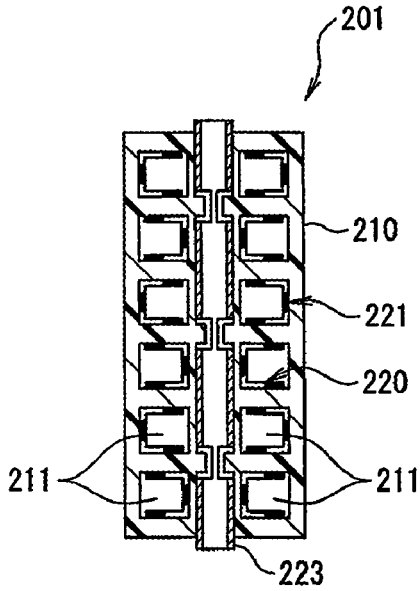
PRIOR ART FIG. 11B
FIG. 11B is a top sectional view of the high-density connector of FIG. 11A.

As shown in FIG. 9A-9C, a plurality of the mating contacts 60 are connected to differential transmission lines C1*c* of cables C1, core wires C2*b* of cables C2, or grounding members 82 of a ground pin 80. As shown in FIG. 9C, the differential transmission lines C1*c* of the cables C1 are connected by soldering S2 to the connecting members 62 of the respective mating contacts 60. The core wires C2*b* of the cables C2 are connected by soldering (not shown) to the connecting members 62 of the respectively mating contacts 60. As shown in FIG. 7C, the grounding members 82 of the ground pin 80 are connected by soldering S1 to the connecting members 62 of the respectively mating contacts 60.

As shown in FIGS. 5A-5C, a metal shell 64 covers an upper surface of the mating housing 50. The metal shell 64 is designed to be grounded to the circuit board PCB by contacting the upper shell 31 provided on the connector 1 when the connector 1 mates with the mating connector 40. The shell 64 may be formed, for example, by stamping and forming a metal plate.

Figure 6A:
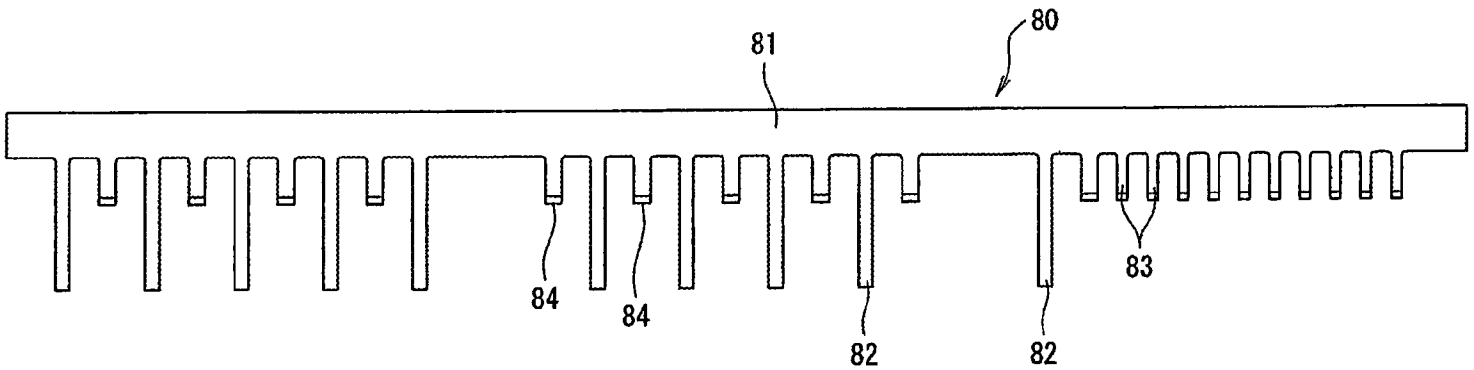
FIG. 6A is a plan view of a ground pin of the mating connector.
Figure 6B:
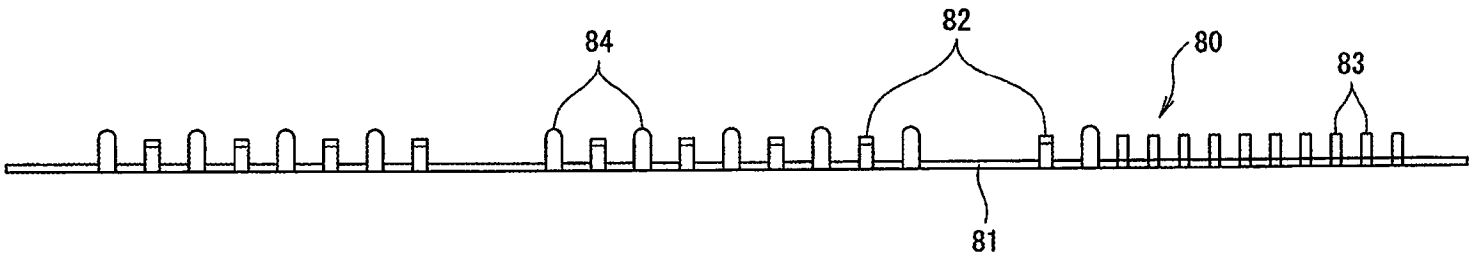
FIG. 6B is a front view of the ground pin of the mating connector.
Figure 6C:
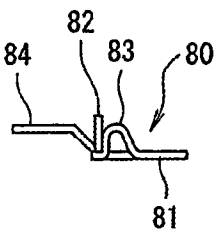
FIG. 6C is a right-side view of the ground pin of the mating connector.

As shown in FIGS. 6A-6C, the ground pin 80 comprises a plate-form member 81 that extends in the direction of length of the mating housing 50. The ground pin 80 may be formed, for example, by stamping and forming a metal plate. A plurality of the grounding members 82 extend forward from the plate-form member 81. A plurality of first supporting projections 83 extend forward from the plate-form member 81. A plurality of second supporting projections 84 extend forward from the plate-form member 81. As shown in FIG. 7C, the grounding members 82 extend forward obliquely upward from the plate-form member 81 and are then bent to extend forward so that the grounding members 82 are connected by the soldering S1 to the connecting members 62 of the respectively mating contacts 60. The ground pin 80 is thereby attached to the mating housing 50. The first supporting projections 83 extend forward from the plate-form member 81 in a reverse U shape so that the first supporting projections 83 support the core wires C2*b* of the adjacent cables C2 by being positioned between the covering members C2*a* that cover the core wires C2*b* of the adjacent cables C2, as shown in FIG. 9B. The second supporting projections 84 extend forward from the plate-form member 81 and then extend upward so that the second supporting projections 84 support the differential transmission lines C1*c* of each of the cables C1 by being positioned between the covering members C1*b* that cover the differential transmission lines C1*c*, as shown in FIG. 9B. As is shown in FIGS. 7A-7B, the ground pin 80 is carried on the extension member 52 with both ends of the plate-form member 81 being positioned at the ground pin positioning recessed members 54 of the mating housing 50.

Figure 8:
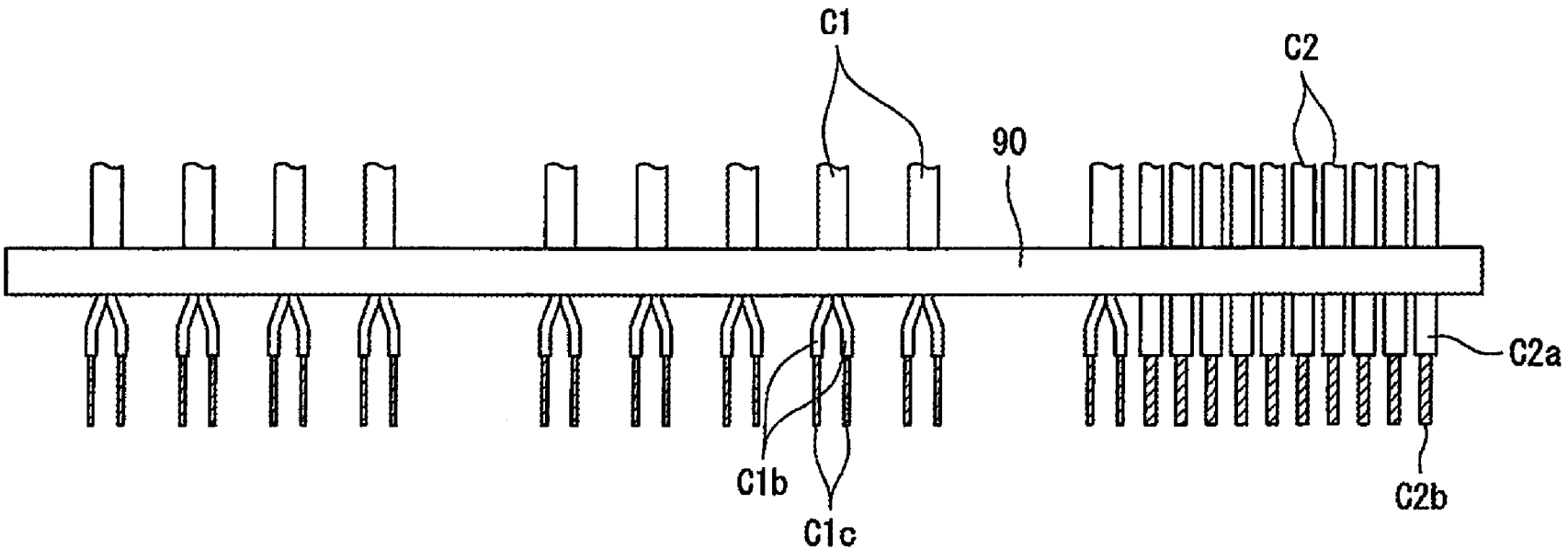
FIG. 8 is a plan view of a ground bar of the mating connector shown attached to a plurality of cables.

As shown in FIGS. 8 and 9B, a ground bar 90 is constructed from a flat plate-form member and extends in the direction of length of the mating housing 50. The ground bar 90 may be formed, for example, from metal. As shown in FIG. 9C, the ground bar 90 is configured to be connected to the braided wires C1*a* of the plurality of cables C1 and the braided wires (not shown) of the plurality of cables C2. As shown in FIGS. 9A-9B, while both ends in the direction of length of the ground bar 90 are positioned at the ground pin positioning recessed members 54 of the mating housing 50, the braided wires of the respective cables C1, C2 are placed on the plate-form member 81 of the ground pin 80. The braided wires of the respective cables C1, C2 are then connected by soldering S3 to the plate-form member 81 of the ground pin 80, and the differential transmission lines C1*c* of the respective cables C1 and the core wires C2*b* of the respective cables C2 are connected by soldering to the connecting members 62 of the corresponding mating contacts 60 so that the ground bar 90 is attached to the mating housing 50.

When the differential transmission lines C1*c* of the respective cables C1 are connected by soldering to the connecting members 62 of the corresponding mating contacts 60, each of the second supporting projections 84 of the ground pin 80 supports the differential transmission lines C1*c* of each of the cables C1 by being positioned between the covering members C1*b* that cover the differential transmission lines C1*c*. Accordingly, the distance between the differential transmission lines C1*c* is smoothly maintained so that the alignment of the differential transmission lines C1*c* is made easy, and solder connections are easily performed. When the core wires C2*b* of the respective cables C2 are connected by soldering to the connecting members 62 of the corresponding mating contacts 60, the first supporting projections 83 of the ground pin 80 support the core wires C2*b* of adjacent cables C2 by being positioned between the covering members C2*a* that cover the core wires C2*b* of the adjacent cables C2. Accordingly, the distance between the core wires C2*b* of the adjacent cables C2 is maintained so that the alignment of the core wires C2*b* is made easy, and solder connections are easily performed.

Figure 4:
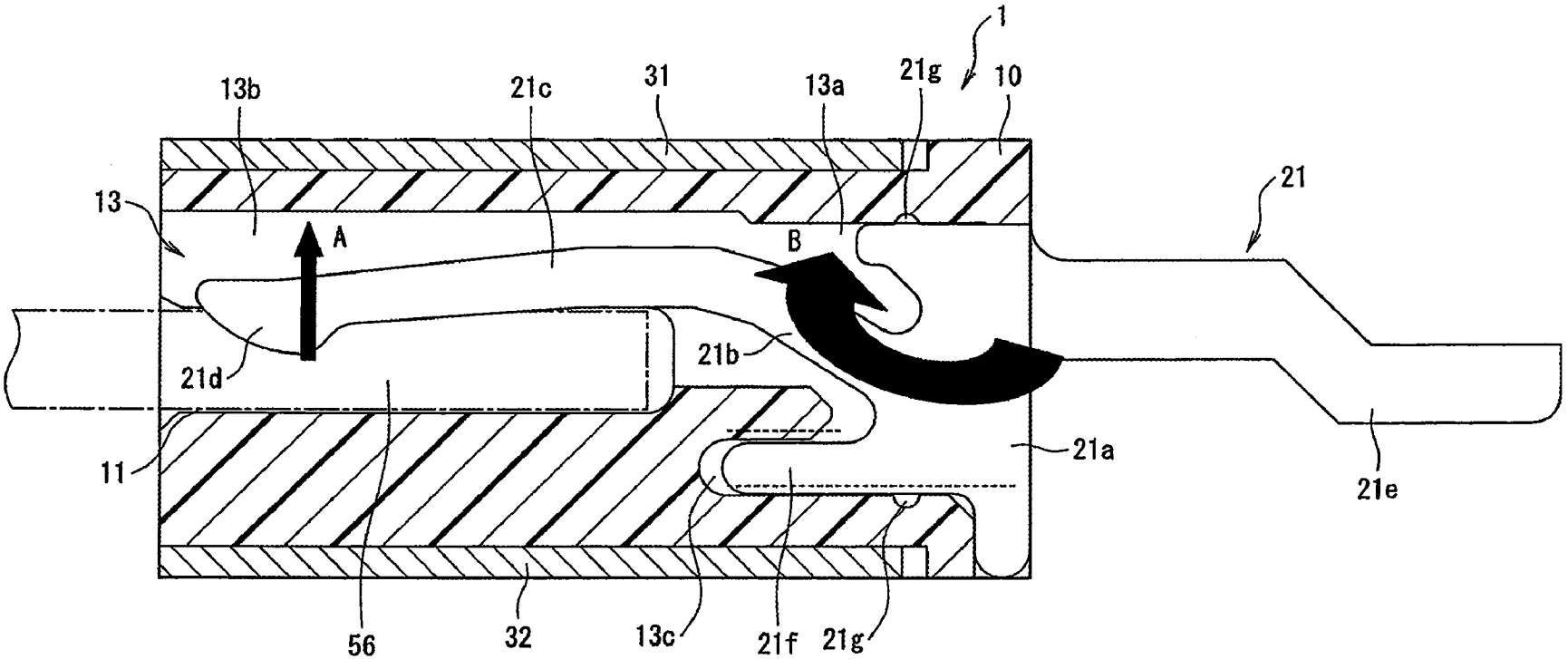
FIG. 4 is a sectional view along line 3A-3A of FIG. 2B showing a direction of the torque that acts on first contacts of the connector when a mating member of the mating connector mates with the connector.

In addition, when the mating member 56 of the mating connector 40 mates with the mating member receiving recess 11 of the connector 1, the contact projections 21*d* provided on the contact arms 21*c* of the first contacts 21 respectively contact the first or upper surfaces of the contact members 63 of a plurality of the mating contacts 60, while the contact projections 22*d* provided on the contact arms 22*c* of the second contacts 22 respectively contact the second or lower surfaces of the contact members 63 of a plurality of the mating contacts 60. As shown in FIG. 4, the contact arms 21*c* of the first contacts 21 are displaced upward (in a direction of arrow A), which causes an upward torque in a direction of arrow B to be generated in the base members 21*a* of the first contacts 21. Although not shown in the figures, the contact arms 22*c* of the second contacts 22 are displaced downward, which causes a downward torque to be generated in the base members 22*a* of the second contacts 22. When such a torque is generated, there is a danger that the upper and lower press-fitting members 21*g*, 22*g* will not be able to withstand the torque and will cause the first and second contacts 21, 22 to rotate. The first and second projections 21*f*, 22*f* arranged in the projection receiving openings 13*c*, 14*c*, however, contact the inner wall surfaces of the respective projection receiving openings 13*c*, 14*c* so that the torque is absorbed. Accordingly, there is no rotation of the first or second contact 21, 22. It is therefore possible to reduce the dimensions of the upper and lower press-fitting members 21*g*, 22*g* in the housing 10 and the dimensions of the base members 21*a*, 22*a*.

The foregoing illustrates some of the possibilities for practicing the invention. Many other embodiments are possible within the scope and spirit of the invention. For example, it is not necessary that each of the first or contact arms 21*c*, 22*c* extend via the respective inclined member 21*b*, 22*b*, as described herein. Additionally, instead of the mating connector 40, the object of connection may also be a circuit board, a card, or the like. It is, therefore, intended that the foregoing description be regarded as illustrative rather than limiting, and that the scope of the invention is given by the appended claims together with their full range of equivalents.

What is claimed is:

1. A connector, comprising:

an insulating housing having first and second contact accommodating compartments formed in a single row along a direction of length of the housing, the first and second contact accommodating compartments being alternately disposed along the direction of length of the housing, each of the first and second contact accommodating compartments having upper and lower walls extending in an axial direction of the respective first or second contact accommodating compartment, the upper wall or the lower wall being provided with a projection receiving opening;

first contacts arranged in the first contact accommodating compartments and second contacts arranged in the second contact accommodating compartments, each of the first and second contacts having a substantially rectangular base member with an upper surface provided with an upper press-fitting member that engages the upper wall and a lower surface provided with a lower press-fitting member that engages the lower wall, the base member having a contact arm extending from a front end thereof and a board connecting member extending from a rear end thereof; and a first projection extending from a front end of the base member of the first contact adjacent to the lower press-fitting member and a second projection extending from a front end of the base member of the second contact adjacent to the upper press-fitting member, the first and second projections extending in the axial direction of the respective first or second contact accommodating compartment and contacting inner wall surfaces of the projection receiving opening.

2. The connector of claim 1, wherein each of the contact arms have contact projections extending toward a side of the housing having the projection receiving opening.

3. The connector of claim 1, wherein the first and second contacts are formed from a metal plate.

4. The connector of claim 1, wherein the contact arms extend forward along the axial direction of the respective first or second contact accommodating compartment.

5. The connector of claim 4, wherein the contact arms extend from an inclined member that extends away from the respective first or second projection.

6. The connector of claim 1, wherein the first and second contacts are press-fitted into a rear surface of the housing.

7. The connector of claim 1, wherein the contact arm, the first or second projection, and the board connecting member are arranged between the upper and lower press-fitting members.

8. The connector of claim 1, wherein the contact arm is arranged between the upper and lower press-fitting members.

9. The connector of claim 1, wherein the contact arms of the first contacts contact a first surface of a mating contact.

* * * * *